United States Patent [19]

Baumgarten

[11] 4,356,706

[45] Nov. 2, 1982

[54] THERMALLY-INTEGRATED HEAT EXCHANGER AND REFRIGERATOR

[76] Inventor: Ronald Baumgarten, 217 E. 78th St., New York, N.Y. 10021

[21] Appl. No.: 175,519

[22] Filed: Aug. 5, 1980

[51] Int. Cl.[3] ..... F25B 27/02

[52] U.S. Cl. ..... 62/238.6; 62/324.4; 237/2 B; 237/19

[58] Field of Search ..... 62/238.6, 324.4, 79; 237/2 B, 19

[56] References Cited

U.S. PATENT DOCUMENTS

| | | | |
|---|---|---|---|
| 1,874,803 | 8/1932 | Reed | 62/238.6 |
| 2,986,899 | 6/1961 | Schenk et al. | 62/196 B |
| 3,905,202 | 9/1975 | Taft et al. | 62/510 X |
| 4,123,003 | 10/1978 | Winston | 237/2 B |
| 4,168,745 | 9/1979 | Lastinger | 62/238.6 |
| 4,178,769 | 12/1979 | Johnsen | 62/238.6 X |
| 4,226,606 | 10/1980 | Yaeger et al. | 62/238.6 |
| 4,241,588 | 12/1980 | Murphy et al. | 62/238.6 |
| 4,254,630 | 3/1981 | Geary | 62/238.6 |
| 4,281,519 | 8/1981 | Spath et al. | 62/79 |

FOREIGN PATENT DOCUMENTS

| | | | |
|---|---|---|---|
| 606735 | 10/1960 | Canada | 62/238.6 |
| 2530994 | 1/1977 | Fed. Rep. of Germany | 62/238.6 |
| 2750093 | 5/1978 | Fed. Rep. of Germany | 62/238.6 |

*Primary Examiner*—Lloyd L. King
*Attorney, Agent, or Firm*—Michael Ebert

[57] ABSTRACT

A thermally-integrated system combining a heat exchange unit including a tank containing unpressurized water with a compressor-type refrigerator in a manner whereby energy for heating cold water conducted through the unit in a pressurized cold water line is extracted from the refrigerator. In the system, an external line carrying the hot refrigerant and acting as an auxiliary condenser is extended from the compressor of the refrigerator to the main condenser thereof, the external line passing through the water tank of the heat exchange unit in heat exchange relationship with the water line both in the upper and lower region of the tank whereby heat is transferred to the cold water.

8 Claims, 3 Drawing Figures

Evaporator
Compressor
Automatic Control
Pressure Transducer
Pressure Controller
Main Condenser
Hot Water
10
11
12
13
14
15
16
17
18
19
20
21
22
23
24
25
26
27
27A

THERMALLY-INTEGRATED HEAT EXCHANGER AND REFRIGERATOR

BACKGROUND OF THE INVENTION

This invention relates generally to a system combining a heat exchange unit including a water tank with a compressor-type refrigerator in a manner whereby energy for heating cold water conducted through the unit is extracted from the refrigerator, and more particularly to a thermally-integrated system of this type in which the heat dissipated by the refrigerator unit is fully exploited, yet its efficiency is maintained despite changing temperature conditions in the water tank.

There are many facilities which require a compressor-type refrigerator as well as running hot water. Thus the typical restaurant must have one or more refrigerators in which to refrigerate vegetables, meats and liquids, and it must also have a hot water supply to carry out various cleaning operations.

In the usual restaurant installation, an electrically energized compressor-type refrigerator is operated in a manner totally independent of the hot water supply, as a consequence of which heat removed in the condensing process is wasted. And where the removed heat is not discharged through an exterior vent but into the refrigerator area, this heat may impose an additional load on an air conditioning system operating in that area. On the other hand, hot water is supplied by conventional water heaters operated by gas, oil, or electrical energy. Where the demand for heated water is high, the energy costs therefor are substantial.

The concept of extracting heat from a refrigerator for the purpose of heating the water in a water heater is well known in the art. Thus in the 1979 U.S. Pat. to Amthor, Jr., No. 4,173,872, the condenser coil of a refrigerator is disposed within a water tank and serves to raise the temperature of the water therein. Arrangements along similar lines are disclosed in the patents to Hammell, U.S. Pat. Nos, 2,668,402; Johnson, 4,178,769; Mueller, 4,146,089 and Eggleston, 2,125,842.

While the arrangements disclosed in these prior patents serve to utilize otherwise wasted energy, they fail to fully and effectively exploit the available heat energy and make no adequate provision to maintain efficient operation of the refrigerator under optimum conditions regardless of the changing demand for hot water normally experienced in a restaurant or similar facility.

For example, if the condenser coil of the refrigerator is disposed within the water tank in heat exchange relation with the water therein, and no water is withdrawn from the tank for a prolonged period, the rising temperature of the water in the tank will approach the temperature of the refrigerant passing through the coil. As a consequence, a proper condensing action will not take place, causing the refrigerator to automatically cut off.

If, on the other hand, heated water is continuously drawn from the water tank so that the temperature of the water in the tank begins to approach the relatively low temperature of incoming water replenishing the water withdrawn from the tank, then an excessive condensing action will take place that will interfere with the proper operation of the refrigeration unit.

In the copending application Ser. No. 141,265, filed May 5, 1980 of Baumgarten et al., whose entire disclosure is incorporated herein by reference, a system is disclosed for combining a water heater tank with a refrigerator whereby energy for heating the water is extracted from the refrigerator, yet the efficiency of the refrigerator is maintained despite changing temperature conditions in the water tank.

In this system, an external line conveying the hot refrigerant and acting as an auxiliary condenser is extended from the compressor of the refrigerator to the main condenser thereof, the external line first passing through the upper region of the tank where it serves in conjunction with a water jacket interposed in the tank outlet pipe as a heat booster. The external line then runs through the lower region of the tank in a coiled formation in heat exchange relation with relatively-cold pressurized incoming water supplied by an inlet pipe, whereby the water heated thereby flows by convection toward the upper region of the tank where the temperature thereof is boosted as the water is discharged through the outlet pipe.

Automatic control means act to divide the condensation function of the refrigerator between the auxiliary and main condensers in response to changing temperature conditions in the water tank, the condensation action of the main condenser being increased when the water in the tank is at a high temperature.

Because of certain code regulations, a system of the type disclosed in our copending application may not be acceptable in some municipalities. The reason for this is that hot water derived from the tank and used for cleaning purposes may become contaminated should a leak develop in the external line passing through the tank. Since this line carries a refrigerant such as Freon intermingled with some lubricating oil from the compressor, a rupture in the external line will introduce the refrigerant and the lubricating oil into the tank water and thereby render the hot water supply impure.

SUMMARY OF INVENTION

In view of the foregoing, the main object of the invention is to provide a system combining a heat exchange unit including a water tank with a compression-type refrigerator in a manner whereby energy for heating the water conducted through the unit by a cold water line is extracted from the refrigerator.

A significant feature of the invention is that the unpressurized water in the tank is isolated from the pressurized water in the line whereby should the tank water become contaminated, the contaminants will not be introduced into the water line. Hence a system in accordance with the invention is in compliance with water purity requirements imposed by municipal codes.

More particularly, an object of this invention is to provide a system of the above type in which an external line carrying the hot refrigerant and acting as an auxiliary condenser is extended from the compressor of the refrigerator to the main condenser thereof, the external line running through the water tank of the heat exchange unit to supply heat to the unpressurized water therein which is transferred to the pressurized cold water running through a line also passing through the tank.

Also an object of this invention is to provide a system of the above type which includes automatic control means to divide the condensation function of the refrigerator between the auxiliary and main condensers in a manner maintaining the operation of the unit at optimum efficiency regardless of the temperature of the water in the heater tank.

Yet another object of this invention is to provide a system of the above type which is of relatively simple design and which operates efficiently and reliably to effect a substantial saving in energy requirements.

Briefly stated, these objects are attained in a thermally integrated system combining a heat exchange unit including an unpressurized water tank with a refrigerator in a manner whereby the heat dissipated by the refrigerator is fully exploited to heat the water in the tank and thereby transfer heat to a pressurized cold water line passing through the tank, the efficiency of the unit being maintained under optimum conditions despite changing temperatures in the water tank.

In the system, an external refrigerant line acting as an auxiliary condenser is extended between the compressor and the main condenser of the refrigerator. The incoming section of the external line carrying the refrigerant in its hot vapor state passes through a booster jacket in the upper region of the water tank, the line then going to the lower region of the tank where its outgoing section assumes the coil formation of an outer helix before exiting from the tank to return to the main condenser of the refrigerator.

Pressurized cold water is fed into the lower region of the tank through a water line whose incoming section assumes the coil formation of an inner helix which extends through the outer helix in heat exchange relationship therewith, the water line then going to the upper region of the tank where its outgoing section passes through the booster jacket in heat exchange relationship with the incoming section of the external line before exiting from the tank.

The system further includes automatic control means to divide the condensation function of the refrigerator between the auxiliary condenser defined by the external line and the main condenser in response to changing temperature conditions in the water tank, the condensation action of the main condenser being increased when the unpressurized water in the tank is at an excessively high temperature and is therefore ineffective with respect to the auxiliary condenser.

OUTLINE OF DRAWINGS

For a better understanding of the invention as well as other objects and further features thereof, reference is made to the following detailed description to be read in conjunction with the accompanying drawings, wherein.

DESCRIPTION OF INVENTION

Figures 1, 2:
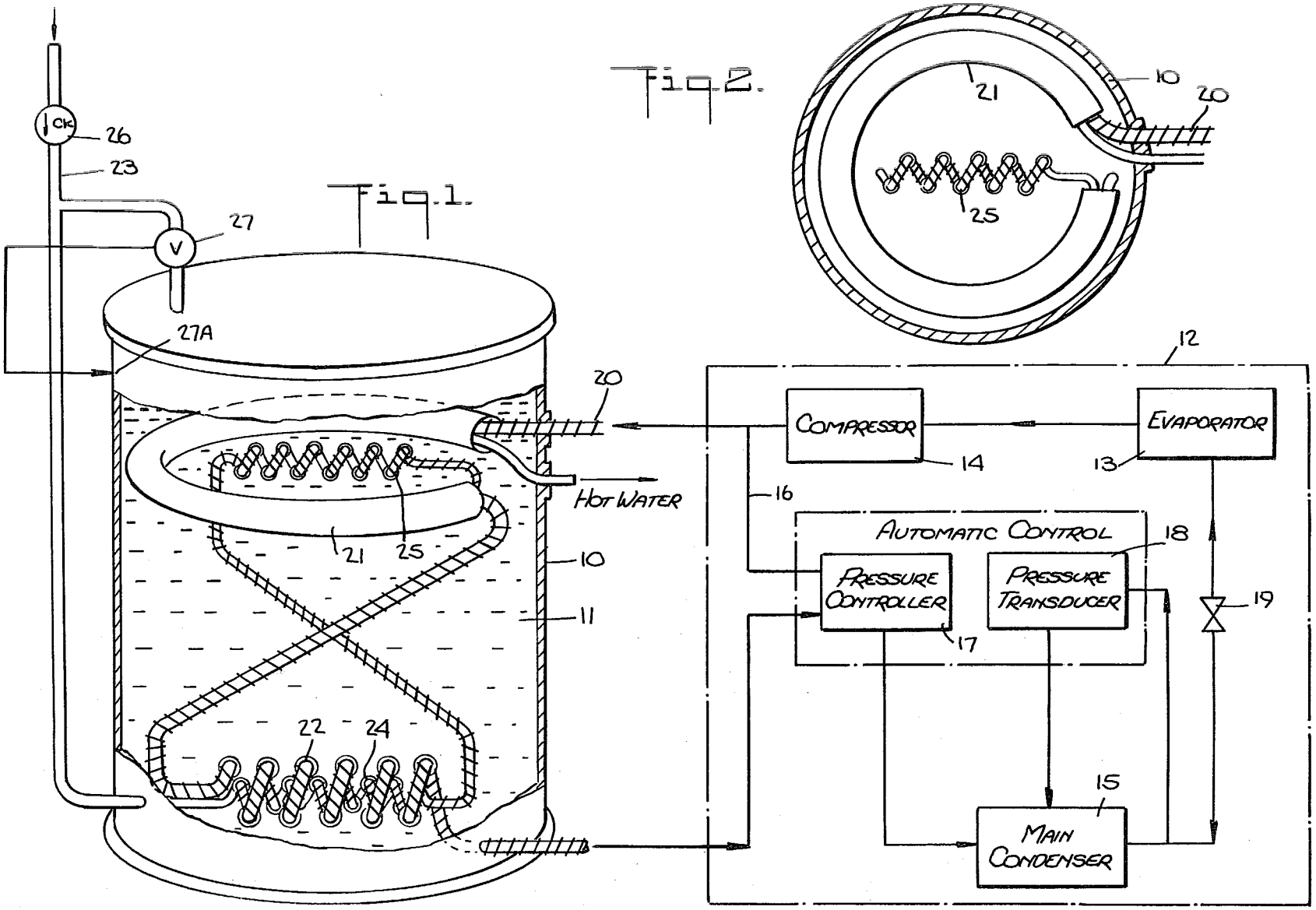
FIG. 1 is a block diagram of a thermally-integrated system in accordance with the invention in which a heat exchange unit including a water tank is combined with a compressor type refrigerator, the water tank of the heat exchange unit being shown in section.
FIG. 2 is a top view of the heat exchange water tank.
Figure 3:
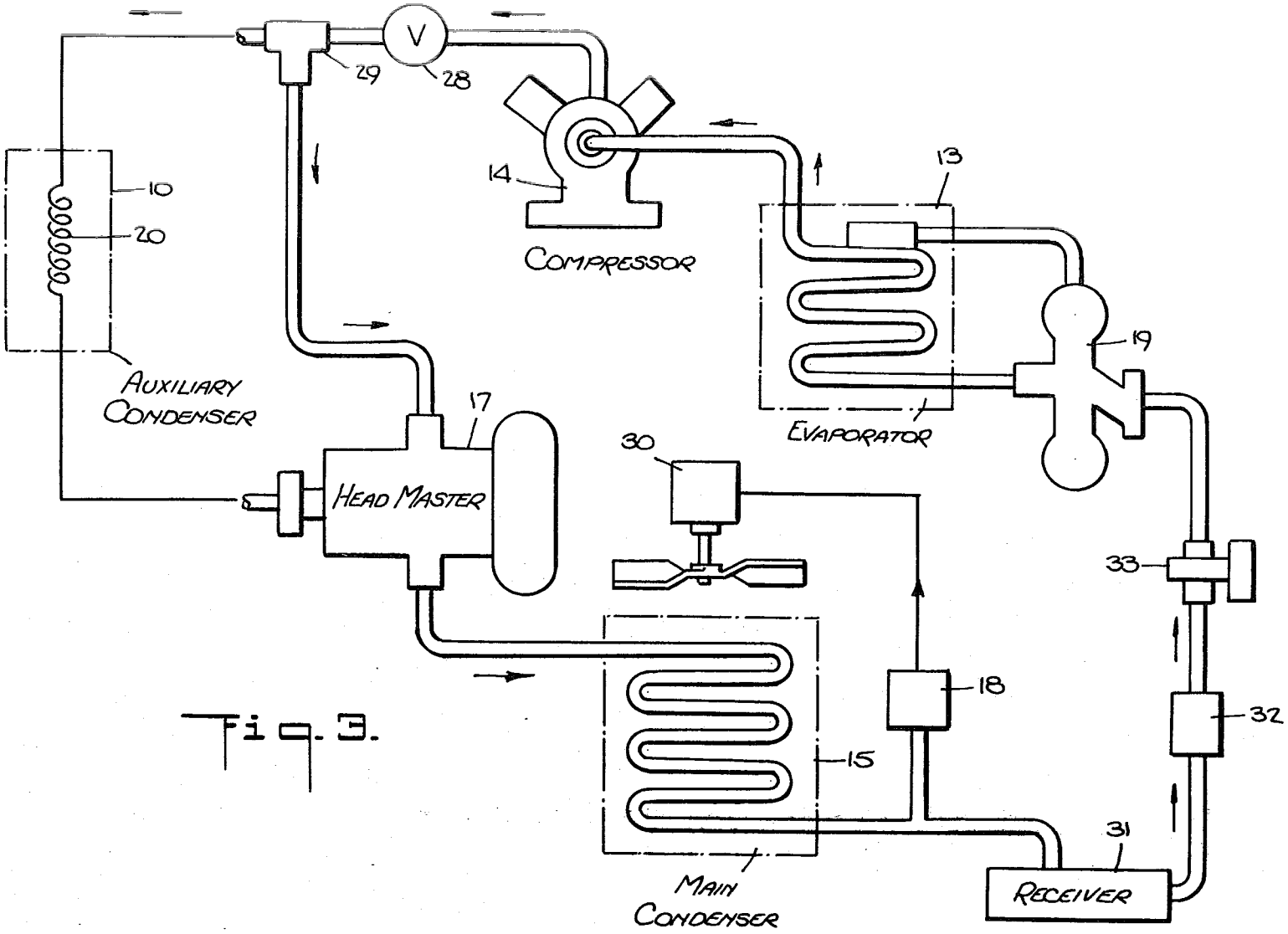
FIG. 3 is a schematic diagram of the refrigerator.

Referring now to FIG. 1, a thermally integrated system in accordance with the invention comprises a heat-exchange unit including a water tank 10 filled with unpressurized water 11, the unit operating in combination with a refrigerator—generally designated by numeral 12. The arrangement is such that heat given off by refrigerator 12 serves to heat water 11 which transfers its heat to pressurized water passing through a cold water line.

It is known that the temperature at which a liquid boils and turns to vapor depends on ambient pressure. Thus at atmosphere 1 (normal atmospheric pressure), water boils at 100° C., but at a reduced pressure of 0.1 atmosphere, it boils at only 46° C. Conversely, water vapor at 50° C. at 0.1 atmosphere can be condensed and thereby converted back to liquid simply by increasing the pressure to, say, 1 atmosphere. It is also known that in passing from the liquid to vapor phase, every liquid absorbs heat and that it subsequently gives off this heat on condensing. In modern refrigerators, use is made of a refrigerant with a low boiling point, such as Freon.

In the compressor-type refrigerator 12, when the refrigerant is under low pressure it is evaporated in an evaporator 13 which takes the form of a coiled pipe installed in the freezer compartment of the unit. Evaporation draws heat from the freezer compartment to lower its temperature, the extracted heat raising the temperature of the refrigerant vapor. The hot vapor is drawn out of evaporator 13 by a compressor 14 which compresses the vapor. In a conventional refrigerator, the compressor feeds the hot vapor to a condenser, In the present invention, compressor 14 passes the hot vapor to a main condenser 15 through an internal line 16 having a pressure controller or head master 17 interposed therein whose main function will be later explained.

When main condenser 15 is rendered active by a pressure transducer 18, whose function will also be later explained, it dissipates the heat from the vapor passing therethrough. As a result of the pressure applied to the vapor by the compressor and the loss of heat experienced in the condenser, the refrigerant condenses. Finally, the refrigerant, which is now in the liquid state, is expanding in an expansion valve 19 to reduce its pressure, this low pressure liquid being returned to evaporator 13 to repeat the refrigeration cycle.

Water tank 10 is coupled to refrigeration unit 12 by an external line 20 which functions as an auxiliary condenser, the line carrying the hot vapor from compressor 14 through the upper region of water tank 10. The external line, which is preferably in the form of a copper pipe, has a helical fin thereon to promote heat thereon to promote heat radiation. The incoming section of the external line is looped in the upper region of the tank and is surrounded by a water jacket 21.

From water jacket 21, external line 20 extends downwardly in the tank to the lower region thereof where its outgoing section assumes the coil formation of an outer helix 22, the external line then exiting from tank 10 to go to main condenser 15 through pressure controller 17. Incoming water under pressure from a municipal or other available supply is fed into tank 10 through an inlet line 23 which enters the lower region of the tank where its incoming section assumes the coil formation of an inner helix 24 extending through outer helix 22. From the outer helix 22, the water line is extended upwardly to the upper region of the tank wherein its outgoing section is coiled to form a helix 25 before entering booster jacket 21 from which it exits from the tank.

The auxiliary condenser defined by external line 20 effects condensation of the hot vapor from compressor 14. Such condensation occurs in the relatively cool lower region of water tank 10 where the hot vapor passes through outer helix 22. As a consequence, the water heated in the lower region of the tank transfers heat to the cold water conducted through the inner helix 24, the hot water in the tank flowing by convection toward the upper region thereof. When passing through water jacket 21 surrounding the incoming section of external line 20 in the upper region, the heated water in the outgoing section of the pressurized line is further heated by the incoming hot vapor. Thus, flow in the incoming section of the external line in the outgoing section of the water line are in counter-current relation. Jacket 21, which thermally intercouples the inflowing hot vapor external line and the outflowing pressurized water line, functions as a heat booster.

A check valve 26 in the incoming cold water line prevents backflow of water on this line. Since the unpressurized water in tank 10 is heated to a fairly high temperature, water is gradually lost as a result of evaporation. Make-up water is therefore provided through a stub line having a control valve 27 therein whose operation is governed by a float or other type of water level sensor 27A to automatically maintain the desired level of water in tank 10.

Should a rupture occur in the external line conveying the refrigerant through tank 10, this will result in contamination of the unpressurized water therein and will disrupt the operation of refrigerator 12. However, the water line passing through the tank will not be affected by these contaminants, for the line water is isolated from the tank water. In the unlikely event that the water line going through the tank is ruptured, the pressurized cold water will quickly cause an overflow condition in the tank, thereby calling attention to this break, at which point the system must be shut down to repair the break.

In practice, the temperature of the hot vapor from the compressor is in excess of 160° F. The auxiliary condenser constituted by external line 20 within water tank 10 serves to raise the temperature of the pressurized water in the line conducted through the tank to as high as 150° F. Water at this temperature is sufficiently hot for most cleansing functions.

The present arrangement effects a considerable economy in energy costs, for the refrigerator consumes its normal amount of energy; whereas there are no energy requirements for the heat exchange unit, which makes use of heat generated by the refrigerator that is otherwise wasted.

There are two conditions which arise that require compensation in order to maintain the refrigerator in operation with optimum efficiency. The actual demand for hot water on an hour-to-hour basis, say, in a restaurant, cannot be foreseen; for there are occasions when very little hot water is taken from the water line and others when the water is being withdrawn almost without interruption. Obviously when pressurized water is conducted through the heat exchange unit without interruption, heat is continuously drawn from the tank; whereas if there is no water flow, the only heat dissipated is that radiated from the tank.

Let us first consider the situation in which little hot water is used for a prolonged period. The temperature of the incoming cold water is usually between about 40 and 50 degrees Fahrenheit, depending on the season of the year and the nature of the water source. The auxiliary condenser in tank 10 formed by external line 20 carries a refrigerant whose temperature is between about 160 and 170 degrees Fahrenheit. Because of this heat exchange relationship which exists in tank 10 between the external refrigerant line and the water line, if no cold water flows through the water line, the tank water temperature will gradually approach that of the hot refrigerant.

As a consequence of this action, the heat differential between the hot water in the tank and the temperature of the refrigerant running through auxiliary condenser 20 is not sufficient to effect condensation of the refrigeration. This condition is reflected in the increased pressure developed at the output side of main condenser 15 which up to this point has remained in the inactive state.

Main condenser 15 may be in the form of a heat exchange coil operating in conjunction with a fan to dissipate the heat in the refrigerant conducted through the coil, thereby condensing the refrigerant. Or it may make use of a water flow system which runs over the condenser coil to carry away the heat for the same purpose. Condenser 15 is effectively inactive when either the fan or the water flow system is cut off.

In order to render main condenser 15 active when auxiliary condenser 22 is unable to effect condensation because of the elevated temperature of the water in the tank, pressure transducer 18, which senses this condition, acts to turn on the fan or render the water flow system effective, depending on the nature of the main condenser. Thus in the case of a fan-operated main condenser, the pressure transducer actuates a switch when the water temperature in the tank exceeds, say, 135° to 140° F. and the resultant pressure exceeds a pre-set level. In the case of a water-cooled condenser, pressure transducer 18 functions to open a valve to initiate the flow of water.

The second condition encountered in practice occurs when water is drawn from the water line at so rapid a rate that the water in the tank is not permitted to rise in temperature well above the cold water temperature of 40° to 50° F. to about 125° to 135° F., the preferred hot water temperature. In this situation, the water temperature in the tank begins to approach the low temperature of the incoming water, in which event excessive condensation occurs in the auxiliary condenser, which condition is reflected by the reduced pressure in the output of the auxiliary condenser.

Pressure controller 17, which in practice may be a "Head Master" pressure regulator, such as that marketed by the Alco Control Division of Emerson Electric Co., is responsive to the pressure differential between the input and output of the auxiliary condenser line 20. This regulator acts to divert hot vapor from compressor 14 away from the auxiliary condenser 20 and to feed it directly into main condenser 15 through internal line 16 to an extent necessary to provide the optimum pressure conditions. In this situation, main condenser 15 is in its inactive state, whereas the auxiliary condenser 20 in a sense is excessively active. Hence by distributing the hot vapor between the two condensers, the proper degree of condensation is attained.

Pressure controller 17 and pressure transducer 18 form an automatic control assembly to regulate the operation of the thermally integrated system to maintain the refrigeration unit in efficient operation regardless of the temperature in the water tank.

In FIG. 2, the refrigeration unit is shown in greater detail, whereas the water heater tank 10 has its auxiliary condenser 20 represented schematically. It will be seen that the output of compressor 14 is fed to auxiliary condenser 20 through a check valve 28 and that internal line 16 is coupled to the input to the auxiliary condenser by a T-junction 29. Main condenser 15 is rendered active by a motor-driven fan 30 whose operation is governed by pressure transducer 18, such that if the water in tank 10 is so hot that effective condensation does not take place in the auxiliary condenser, then condensation is effected in the main condenser.

From main condenser 15, the refrigerant is conducted to a receiver 31 whose output is fed to a dryer 32. From dryer 31 the refrigerant goes through a solenoid valve 33 to the expansion valve 19 which is a thermo X-pan valve, the expanded refrigerant then going into evaporator 13.

While there has been shown and described a preferred embodiment of a system combining water heater and refrigerator unit in accordance with the invention, it will be appreciated that many changes and modifications may be made therein without, however, departing from the essential spirit thereof. Thus, instead of using a booster jacket to effect heat exchange in the upper region of the tank, this may be effected by using inner and outer helices, as in the lower region, to effect heat transfer between the incoming section of the refrigerant line and the outgoing section of the water line.

While there has been illustrated a system in which the heat exchange unit operates in conjunction with an external line conducting a refrigerant from a single compressor-type refrigerator, the system may be arranged to operate with two or more refrigerators. In that case, the external lines from the refrigerators are paralleled within the heat exchange unit so that the incoming sections of these lines are clustered within the booster jacket in the upper region of the tank while the outgoing sections form multiple helices in the lower region thereof.

Also, the system may be combined with a solar heating system so that heat picked up from the sun is used to heat cold water in the water line running through the tank. In that case, water in the line circulated through a heat collector exposed to the sun is extended into the water tank in the same manner as is shown herein with respect to the external line from the refrigerator, the solar collector line paralleling the refrigerator line to supplement the heat supplied by the refrigerator.

We claim:

1. A thermally-integrated system to produce a supply of hot water comprising:

A a heat exchange unit including a water tank filled with unpressurized cold water and means to maintain said unpressurized water in the tank at a predetermined level;

B a compressor-type refrigerator including an internal line conducting a refrigerant in hot vapor form from a compressor to a normally-inactive main condenser, the refrigerant from the main condenser going through an expansion valve into an evaporator which returns the refrigerant to the compressor;

C an external line functioning as an auxiliary condenser for the refrigerator, said external line running from the compressor to the main condenser through the water tank, the incoming section of the external line conveying the hot refrigerant vapor being disposed in the upper region of the tank and the outgoing section in which the vapor is condensed being disposed in the lower region of the tank; and D a pressurized cold water line runing through said tank, said water line having an incoming section in the lower region in heat exchange relationship with the outgoing section of the internal line whereby the unpressurized water in the lower region of the tank is heated and transfers heat to the pressurized cold water running through the incoming section of the cold water line, the heated tank water in the lower region rising by convection to the upper region of the tank, and having an outgoing section in the upper region in heat exchange relationship with the incoming section of the external line whereby the pressurized cold water is heated in the lower region and its heat is boosted in the upper region.

2. A system as set forth in claim 1, wherein the heat exchange relationship in said lower region is effected by an inner helix formed by the cold water line and an outer helix formed by the external line.

3. A system as set forth in claim 1, wherein the heat exchange relationship in said upper region is effected by a booster jacket surrounding the incoming section of the internal line and the outgoing section of the water line.

4. A system as set forth in claim 1, wherein said external line is a pipe having a helical fin thereon to promote heat radiation.

5. A system as set forth in claim 1, further including means to render said main condenser active when the water temperature in the tank is too high to effect condensation of the hot vapor by the auxiliary condenser.

6. A system as set forth in claim 5, wherein said means to render said main condenser active includes a pressure-responsive transducer coupled to the output of the main condenser to produce a control signal when the tank water temperature exceeds a predetermined level.

7. A system as set forth in claim 6, wherein said main condenser is activated by a motor-driven fan responsive to said control signal.

8. A system as set forth in claim 1, further including a pressure-responsive controller for governing the flow of refrigerant from the auxiliary condenser into the main condenser and coupled between the incoming line and the main condenser to bring about a distribution of the hot vapor between said auxiliary and main condensers in response to excessive condensation in said auxiliary condenser.

* * * * *